United States Patent [19]

Stäheli

[11] Patent Number: 4,696,608

[45] Date of Patent: Sep. 29, 1987

[54] TRANSPORT DUCT FOR FIBER FLOCKS

[75] Inventor: Paul Stäheli, Wilen bei Wil, Switzerland

[73] Assignee: Maschinenfabrik Rieter A.G., Winterthur, Switzerland

[21] Appl. No.: 792,829

[22] Filed: Oct. 28, 1985

[30] Foreign Application Priority Data

Oct. 30, 1984 [CH] Switzerland ..... 5176/84

[51] Int. Cl.[4] ..... B65G 53/36; B65G 53/40

[52] U.S. Cl. ..... 406/155; 406/156; 406/192; 19/105

[58] Field of Search ..... 406/83, 191, 154–156, 406/192, 195; 19/105; 251/127, 298

[56] References Cited

U.S. PATENT DOCUMENTS

| | | | |
|---|---|---|---|
| 362,041 | 4/1887 | Sailor | 406/156 |
| 1,044,418 | 11/1912 | Reed | 406/155 X |
| 2,585,301 | 2/1952 | Doss . | |
| 3,157,440 | 11/1964 | Hijiya et al. | 406/156 X |
| 4,154,485 | 5/1979 | Lytton et al. | 406/156 X |

FOREIGN PATENT DOCUMENTS

| | | | |
|---|---|---|---|
| 373722 | 4/1923 | Fed. Rep. of Germany . | |
| 1229884 | 12/1966 | Fed. Rep. of Germany . | |
| 1510413 | 1/1970 | Fed. Rep. of Germany . | |
| 797145 | 4/1936 | France | 406/192 |
| 156576 | 12/1981 | Japan | 251/298 |
| 463333 | 11/1968 | Switzerland | 19/105 |
| 1178483 | 1/1970 | United Kingdom . | |

*Primary Examiner*—Andres Kashnikow
*Assistant Examiner*—MaryBeth O. Jones
*Attorney, Agent, or Firm*—Michael J. Striker

[57] ABSTRACT

A transport duct for fiber flocks and similar fibrous material communicates via a plurality of openings with a corresponding plurality of feeding chutes leading to flock-processing equipment, such as carding machines. The duct includes at least one, but preferably more than one, duct section at which the duct undergoes an abrupt change of direction by between 70° and 110°, so that the fibrous material which is carried through the interior of the duct by a transport medium is slowed down by contact with the duct and then descends more abundantly than otherwise into the chute that immediately follows such section as considered in the direction of flow of the transport medium. The presence of the section or sections with abrupt direction change also makes it possible for the duct to circumvent any obstructions which may be present between the individual chutes at the location of use of the duct, thus permitting optimum utilization of available floor space.

12 Claims, 4 Drawing Figures

TRANSPORT DUCT FOR FIBER FLOCKS

BACKGROUND OF THE INVENTION

The present invention relates to transport ducts in general, and more particularly to a transport duct for fiber flocks.

It is known, for instance from the published German patent application DE-OS No. 15 10 413, to supply two parallel columns of carding machines with fiber flock by means of a transport duct. It is also known from this published application to supply a column and a row of carding machines parallel thereto with fiber material by means of a transport duct. The transport duct in this instance runs in two straight portions parallel to the parallel columns, or to the parallel column and row, of carding machines. One of the straight portions of the duct is connected to the other straight portion of such duct by a U-shaped, softly or gradually curved connection portion. Because of this soft curvature, the fibrous material carried by a transport medium through the interior of the duct does not suffer any appreciable deceleration while traveling in the connection portion.

In providing a layout for machines to be supplied with fiber flocks, such as cards, carding machines or long staple fiber carding machines, it is often not possible to place the machines in rows and columns, as would be desired for optimum exploitation of the available floor space, for instance, because of the presence of support columns, projections, the shape of the carding room or the presence of other equipment. Thus, it is often necessary either to deviate from the optimum layout to be able to use a single transport duct for the supply of the fiber flocks to all of such machines, or to utilize more than one such transport duct, with additional complexity and expense.

SUMMARY OF THE INVENTION

Accordingly, it is a general object of the present invention to avoid the disadvantages of the prior art.

More particularly, it is an object of the present invention to provide a transport duct construction that does not possess the disadvantages of the known transport duct constructions.

Still another object of the present invention is so to construct the transport duct of the type here under consideration for transporting fibrous material as to be able to control the rate of deliver of the fibrous material to the individual chutes that communicate with the duct and lead to fiber-processing equipment.

It is yet another object of the present invention so to design the transport duct of the above type as to avoid otherwise existing constraints with respect to the layout of the machines to be supplied with the fibrous material from the same transport duct.

A concomitant object of the present invention is to develop a transport duct of the above type which is relatively simple in construction, inexpensive to manufacture and install, easy to use, and reliable in operation nevertheless.

In pursuance of these objects and others which will become apparent hereafter, one feature of the present invention resides in a transport duct of a substantially constant rectangular cross section for feeding a fibrous material carried by a transport medium flowing through the interior of the duct via respective openings into a plurality of chutes which are spaced from one another longitudinally of the duct and lead to processing equipment for the fibrous material, comprising at least one duct section situated immediately upstream of one of the chutes as considered in the direction of flow of the transport medium, at which the duct undergoes an abrupt change of direction of between 70° and 110° for the fibrous material to be decelerated by contact with the duct and descend more abundantly than otherwise into the one chute. A particular advantage of this construction is that a flexibility is obtained regarding the layout of the machines without special expenditure. This results in cost saving. A combined longitudinal and transverse layout of cards is readily possible. Furthermore, an improvement in the control of the quantity of flocks fed into the chute is obtained, together with an improvement in the homogeneity of deposition of flocks in the chute.

According to a further aspect it is also advantageous when each of the openings is substantially rectangular and has a larger dimension extending parallel to the direction of flow of the transport medium and a smaller dimension extending transversely of such flow and substantially corresponding to the width of the duct.

Another advantageous feature is when an additional duct section is situated immediately dowstream of the one chute as considered in the direction of flow of the transport medium, at which the duct undergoes another abrupt change of direction of between 70° and 110°.

Advantageously, the duct includes respective opposite side walls which laterally delimit the interior of the duct. One of the lateral walls has respective lateral wall portions which meet each other at the section of abrupt direction change along a first vertical edge, and the other of lateral walls has respective lateral wall portions which meet each other at the section of abrupt direction change along a second vertical edge. It is also advantageous when the lateral wall portions of the one and the other lateral walls extend at substantially the right angle with respect to one another from the respective first and second edges.

It is further advantageous when the abrupt change of direction amounts to 90°.

Another advantageous feature resides in each of the openings being substantially rectangular and having a larger dimension extending parallel to, and a smaller dimension extending transversely of, the direction of flow of the transport medium, and when the ratio of the distance of that of the first and second edges that is closer to the opening of the one chute to the larger dimension of the opening is between 0 and 0.3.

It is further advantageous when the interior of the duct has a predetermined width and a predetermined height, and when the ratio of the width to the height lies between 0.3 and 0.6. Advantageously, the width is about 17 centimeters and the height is about 40 centimeters.

In the currently available fiber flock transport systems, the duct portion extending from the supply station to the first feed chute must be relatively long (at least 3 meters). This is avoided in that the duct further comprises at least one other duct section at which the duct undergoes another change of direction of 70° and 110°, and as considered in the direction of flow of the transport medium, those duct portions that constitute the first of the sections meet at a sharp edge, and at least those duct portions that constitute the last of the sections meet at a sharp curve. In this construction, the location of abrupt change of direction of between 70° and 110° before the first feed chute, and thus also this feed chute itself, can be connected to the supply station by a short duct portion. The space made free by the omission of a relatively long duct portion, which is no longer required, can thus be used for other purposes.

According to a further aspect it is also advantageous when the duct includes a top wall, a bottom wall, and two lateral walls together bounding the interior of the duct; and further comprising a control plate mounted in the interior for pivoting about an axis located at the bottom wall and extending transversely of the direction of flow between an open position in which the control plate rests on the bottom wall and a plurality of closing positions in which it partially obstructs the flow of the transport medium, the control plate being situated immediately upstream of the section and extending in the downstream direction from the axis, and being arrestable in the positions thereof.

It is further advantageous when the blocking portion is secured to the control plate at an end portion of the latter which is remote from the axis and extending downwardly from such end portion, and when the bottom wall has an aperture through which the blocking portion extends in all of the positions of the control plate.

Another advantageous feature resides in an additional duct section situated downstream of the one chute as considered in the flow direction, at which the duct undergoes another abrupt change of direction of between 70° and 110°; and further comprising means for controlling the flow of transport medium opposite to the flow direction, including an additional control plate mounted in the interior for pivoting about another axis located at the bottom wall and extending transversely of the flow direction between its open position in which it rests on the bottom wall and a plurality of closing positions in which it partially obstructs the flow of the transport medium opposite to the flow direction, the additional control plate being situated immediately downstream of the section as considered in the flow direction and extending from the axis in the opposite direction than the control plate, and being arrestable in the positions thereof.

The present invention could be very advantageously used at a location where obstructions are present between the chutes, wherein the duct, due to the presence of at least the one duct section, circumvents at least one such obstruction. It can further be used with carding machines arranged in succession, when the duct, due to the presence of at least the one duct section, extends past at least one of the carding machines at one side thereof and past at least one other of the carding machines at the other side thereof. When the transport duct of the present invention is used with carding machines arranged in a plurality of parallel straight rows and columns, it is further advantageous when the duct includes a plurality of duct portions extending over the individual rows of the carding machines, and a plurality of connection portions extending transversely of the duct portions and each joined at each of its ends to a different one of the duct portions by the duct section with the abrupt change of direction amounting to substantially 90°.

The novel features which are considered as characteristic of the invention are set forth in particular in the appended claims. The improved transport duct arrangement itself, however, both as to its construction and its mode of operation, together with additional features and advantages thereof, will be best understood upon perusal of the following detailed description of certain specific embodiments with reference to the accompanying drawing.

DETAIILED DESCRIPTION OF THE DRAWING

Figure 1:
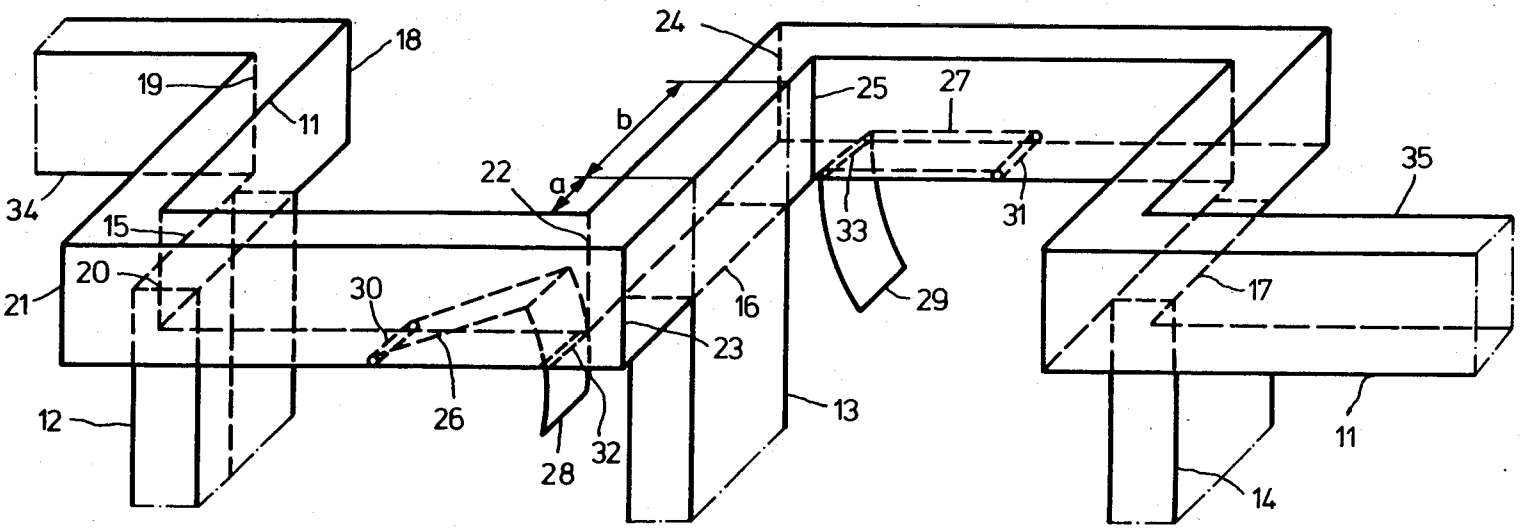
FIG. 1 is a perspective view of a transport duct according to the invention and its assembly with the feed chutes.

Refering now to the drawing in detail, and first to FIG. 1 thereof, it may be seen that the reference numeral 11 has been used therein to identify a transport duct which is to supply fiber flocks or similar fibrous material to feed chutes 12, 13 and 14, each of which is associated with a non-illustrated carding machine. The duct 11 is of substantially constant, rectangular cross section and open into the chutes 12, 13 and 14 via respective openings 15, 16 and 17. The openings 15, 16 and 17 are of a rectangular shape and their width is substantially equal to the width of the duct 11. A transport medium is caused to flow through the duct 11 in operation and serves for transporting fiber flocks through the duct 11 toward and into the chutes 12, 13 and 14.

It is initially assumed that the transport medium flows from left to right as viewed in FIG. 1, that is, from a duct portion 34 to a duct portion 35. As viewed in this direction of flow, the flow through the duct 11 undergoes an abrupt change of direction of 90° upstream of the chute 12 (or its opening 15). This change of direction is effected by a right angle bend in the duct 11. In such a bend, the portions of one side wall of the duct 11 which extend at an angle of 90° to each other are joined along one vertical edge 18, and the portions of the other side wall of the duct 11 which also extend at a right angle to each other are joined along another vertical edge 19.

Immediately downstream of the chute 12, again as considered in the above-mentioned direction of flow of the medium from left to right, there is provided a further location of abrupt change of direction amounting to 90°. Here, the portions of the one duct wall joining together at this location form an edge 20, and the portions of the other duct wall joining together at this location form an edge 21. Furthermore, other edges 22 to 25 are also illustrated in FIG. 1.

Moreover, two control plates 26 and 27 are provided and are located in the interior of the duct 11. The construction, and mode of operation of the control plates 26 and 27 is described in detail in Swiss Patent Application No. 04119/84-1, the disclosure of which is hereby incorporated by reference. The control plate 26 is pivotable about a shaft 30 and the control plate 27 is pivotable about a shaft 31, and they are fixable in any desired pivoted positions. At its end remote from the respective shaft 30 or 31, each of the control plates 26 and 27 carries a respective blocking wall 28 and 29 which is respectively secured thereto. The blocking walls 28 and 29 extend through a bottom wall of the duct 11 via respective slots 32 and 33.

The blocking walls 28 and 29 are of such length as measured away from the respective control plates 26 and 27 that in all pivoted positions of the control plates 26 and 27 they continue to extend into the corresponding slots 32 and 33.

In operation of the transport duct 11, in accordance with the previously made assumption about the flow direction, a fiber-flock-transporting medium flows from the duct portion 34 towards the duct portion 35, each of the chutes 12, 13 and 14 being supplied with fiber flocks via the respective openings 15, 16 and 17. In such an arrangement, normally one duct 11 is associated with substantially more than only the three chutes 12, 13 and 14 mentioned before. For the fiber flock material to be supplied in a problem-free manner to all such chutes represented by the chutes 12, 13 and 14 in particular also to the downstream, subsequent chutes, and in such a manner that no flock depositions and flock blockages arise over the whole length of the duct 11, the transport medium must have a relatively high speed at the entry point in the duct portion 34. This carries with it the danger, however, of the flocks flying straight across at least the first of the openings 15, 16 and 17, that is, across the opening 15, and an insufficient quantity of such flocks descends into the chute 12.

As a result of the abrupt change of the direction of the duct 11 at the location of the edges 18 and 19, in accordance with the invention, the flocks strike against the side wall of the duct 11 which extends from the edge 18 towards the chute 12. Due to this impact, they lose a part of their kinetic energy, move more slowly and thus descend in a greater quantity and evenly into the chute 12. Additionally, good homogeneity of the flock material deposited in the chute 12 is obtained.

At the location of the abrupt change of direction of the duct 11 at the region of the edges 20 and 21, the striking against the side wall is repeated; however, in the adjoining, straight duct portion, the flocks are accelerated again and again reach the speed of the transport medium. Thus, it is clear that the change of direction at the location of the edges 20 and 21 has no disadvantageous results. This gives the advantage that the number of various possibilities for application of the present invention is quite substantially increased.

The dimensions of the transport duct 11 are significant for a satisfactory mode of operation. A width of 17 cm and a height of 40 cm has been found to be particularly advantageous. In general, the range in which the ratio of the width to the height of the duct 11 lies between 0.3 and 0.6 can be considered as advantageous.

The spacing of the location of abrupt change of direction from the chute 12, 13 and 14 immediately following this location is also important. In FIG. 1 of the edges 22 and 23, the edge 22 is closer to the chute 13. If its spacing from chute 13 is represented by a, and the length of the opening 16, or of the chute cross-section, is represented by b, then the ratio of a to b should lie between 0 and 0.3 for an optimum mode of operation. It is possible to operate with the spacing a equal to 0, that is, the chute 13 or the opening 16 extends upto the turning point of the abrupt change of direction, that is to the edge 22.

The control plate 26, which has been left unconsidered in the immediately preceding description, is located immediately upstream of the location of the abrupt change in direction with the edges 22 and 23. If the control plate 26 is fixed in the illustrated inclined position, then it causes deceleration of the flowing transport medium immediately after or behind the control plate 26. The flocks are thus also decelerated. The control plate 26 also serves for regulating the kinetic energy of the flocks and thus for regulating the quantity of flocks passing into the subsequent chute 13. For clarity of illustration, only one combination of the control plate 26 with the blocking wall 28 has been illustrated for the above-mentioned direction of flow. Such combinations can however be provided, as desired, upstream of each chute 12, 13 and 14, especially upstream of the first chute 12.

Through the combination of the locations of abrupt change of direction with such control plates 26, versatile variation possibilities arise for regulation of the deposition of flocks in the chutes 12, 13 and 14.

If only the control plate 26 were provided, there would exist the danger that fiber material could enter between the control plate 26 and the bottom wall of the duct 11 and could remain caught there. In order to avoid this, the blocking plate 28 secured to the control plate 26 can be provided, being carried along during the pivoting of the control plate 26.

As explained in the above mentioned Swiss Patent Application No. 04 119/84-1,it is often desired to cause the transport medium with the flocks to flow along the duct 11 in either the one direction described above or in the other, opposite direction. Accordingly, for this case, such control plates can also be provided for the flow direction which is opposite to that already considered, that is directed from the duct portion 35 to the duct portion 34. The illustrated control plate 27 which is pivotable about the shaft 31, constitutes such a plate. In FIG. 1, the control plate 27 has been shown in its open position in which it rests on the bottom wall of the duct 11 and is practically ineffective. If desired, the blocking plate 29, extending through the slot 33 provided therefor, is also secured to the plate 27.

If, now, the medium flows from right to left as considered in FIG. 1, that is, from the duct portion 35 to the duct portion 34, then the control plate 26 is set in its open position in which it rests on the bottom wall of the duct 11, and the plate 27 is fixed in a desired pivoted position.

Figure 4:
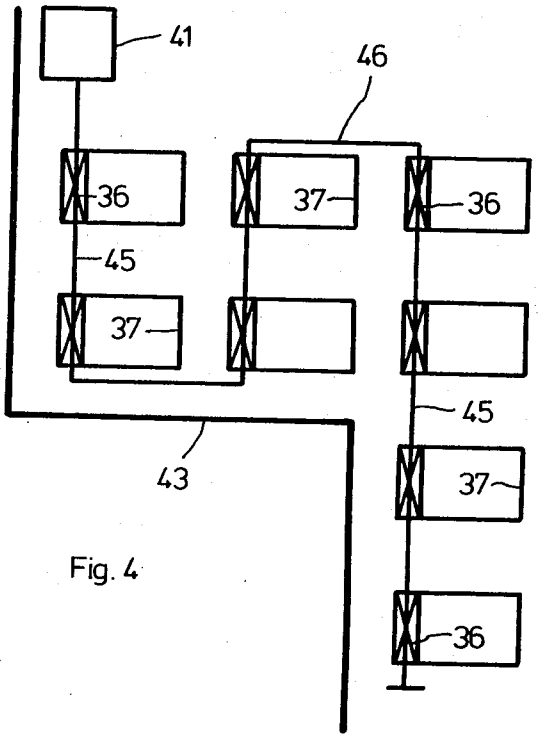
FIGS. 3 and 4 are diagrammatic top plan views of various card arrangements and the ducts serving for supplying the same.

It is a substantial advantage of the invention that it enables varying relative locations of the carding machines. Several examples of such varying arrangements are shown in FIGS. 2, 3 and 4.

Figure 2:
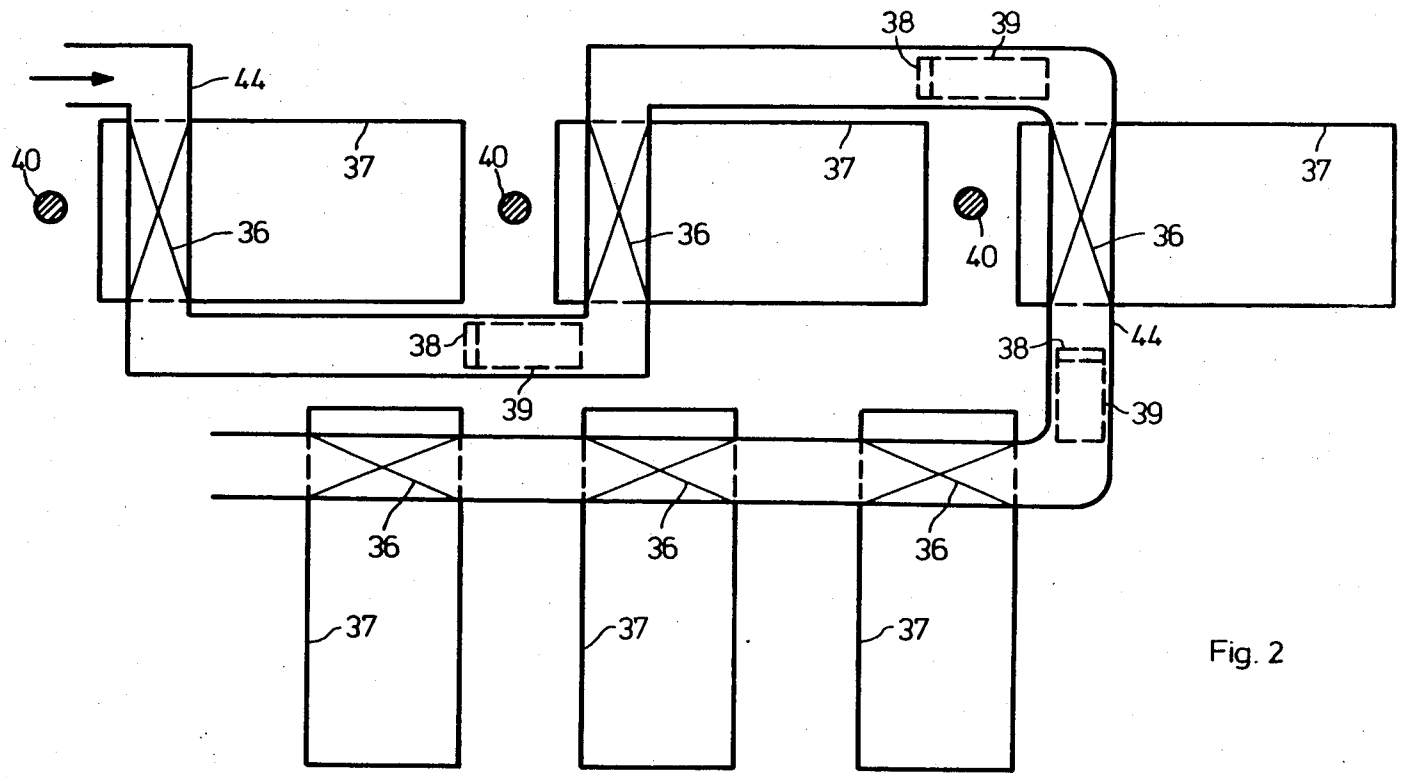
FIG. 2 is a top plan view of another arrangement of a feed chute and of the cards commonly fed by the same transport duct.
Figure 3:
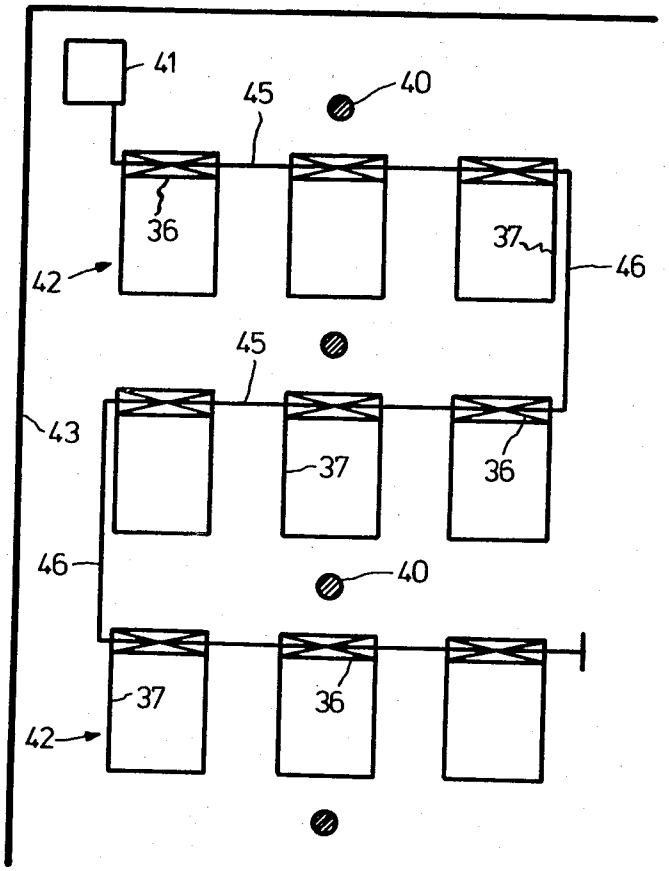

FIG. 2 shows a duct 44 for supplying delivery chutes 36 of carding machines. Furthermore, control plates 39 are shown which are pivotable about their respective shafts 38; the plates 39 can be provided in dependence upon the particular requirements. The reference numeral 40 denotes structural support columns provided in a carding room, the columns 40 forming a hindrance for the transport duct 44 to respective cards 37 located between the columns 40.

It can be seen in the upper half of FIG. 2 that in the illustrated case cards 37 can be located in a column arrangement between the columns 40. Referring to the cards 37 arranged successively, the front side of the card 37 is adjacent the rear side of the other card 37. Due to the provision of the locations of abrupt change of direction, a transport duct 44 can be arranged in spite of the presence of the columns 40. In this manner, space which is not usable with the previously known arrangements can be exploited.

The lower half of FIG. 2 shows a row of cards which are arranged side-by-side relative to each other. This Figure represents an example of an arrangement in which, by means of an abrupt change of direction of between 70° and 110° in the transport duct 44, cards 37 arranged in a column and in a row can be supplied by the same duct 44.

FIG. 2 also shows that at least the first abrupt change of direction is formed by right angle joints and at least the last abrupt change of direction is formed as a sharp curve. Downstream of each chute 36, the speed of the transport medium in the duct 44 is reduced. Thus, the deceleration, or the loss in kinetic energy of the flocks, due to the described striking thereof on the side walls of the duct 44, becomes less necessary, if not superfluous. Thus, in this example, the abrupt change of direction at the start of the duct 44 is initially formed by right angle joints and subsequently as sharp curves. In a further development of this example, the curves can be more gradual the further down the duct 44 they are located.

It should also be mentioned that with respect to all cards 37, the duct 44 runs transverse to the longitudinal direction thereof. Thus, a so-called transverse feed is provided. In such an arrangement, the delivery chutes 36, and thus their openings, have their longer sides parallel to the duct 44 and thus to the direction of flow of the transport medium. If a chute were arranged transversely to the duct 44 in contradistinction to what is shown, it would be filled from one side in its longitudinal direction if a abrupt change of direction were provided.

FIG. 3 shows a further example of the exploitation of space between structural columns 40 which form a hindrance for the transport duct. They show an arrangement of the duct which is possible under these circumstances and by which 9 cards 37 are supplied. Five locations of abrupt change of direction are provided The flock material passes from a flock feeder 41 into the duct which comprises supply duct portions 45 and connection portions 46. The cards 37 are arranged in parallel columns and parallel rows 42. Above each card row 42, or above its delivery chutes 36, there is located the respective duct portion 45. The portions 45 are connected to each other at their ends with abrupt change of direction of 90°, by the connection portions 46 extending at right angles thereto.

Finally, FIG. 4 shows an arrangement of cards in a carding room, in which a right-angled wall 43 stands in the way. The transport duct coming from the flock feeder 41 serves for the supply of 8 delivery chutes 36 associated with the cards 37. The duct again comprises the duct portions 45 located above respective rows of cards 37. The duct portions 45 are again connected to each other, in this example at locations of abrupt change of direction of 90°, by the connection portions 46 arranged at right angles to the duct portions 45, and in this manner these portions 45 and 46 together form the transport duct.

It is clear, that it is possible in accordance with the present invention to provide a full complement of machines in a machine room despite the presence of obstacles therein. For this purpose, the transport duct is guided around the obstacles in the manner indicated above, this possibility being provided by the provision of the locations (in accordance with the invention) of abrupt change of direction of between 70° and 110°.

In the usual arrangements employing the present invention, in general right-angle abrupt changes of direction are used, since in this manner a functional and clear arrangement of the machines is obtained. However, it lies equally within the scope of the invention to provide abrupt changes of direction departing from right angles, for example to take into account machine-location reasons or specific contributions to the reduction of kinetic energy of the flocks. Provided the abrupt change of direction lies in the region between the values of 70° and 110°, a satisfactory operation of deceleration of the flocks in the duct is obtained.

In the present specification only cards are specifically discussed. It should however be mentioned that the invention is equally applicable to long-staple carding machines or other flock processing machines.

It will be understood that each of the elements described above, or two or more together, may also find a useful application in other types of arrangements differing from the type described above.

While the invention has been illustrated and described as embodied in an transport duct for fiber flocks, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contributions to the art and, therefore, such adaptations should and are intended to be comprehended within the meaning and range of equivalence of the claims.

What is claimed as new and desired to be protected by Letters Patent is set forth in the appended claims; I claim:

1. A transport duct of substantially constant cross section for feeding a fibrous material carried by a transport medium flowing through the interior of the duct via respective openings into a plurality of chutes which are spaced from one another longitudinally of the duct and lead to processing equipment for the fibrous material, comprising at least one section of said duct which is situated upstream of one of said chutes as considered in the direction of flow of the transport medium and at which the duct undergoes an abrupt change of direction of between 70° and 110° immediately upstream of said one chute for the fibrous material to be decelerated by contact with the duct and descend more abundantly than otherwise onto said one chute, the duct including respective opposite side walls which laterally delimit the interior of the duct, one of said side walls having respective side wall portions which meet each other at said section of abrupt direction change along a first vertical edge, and the other of said side walls having respective side wall portions which meet each other at said section of abrupt direction change along a second vertical edge, said side wall portions of said one and said other of said side walls extending at substantially a right angle with respect to one another from the respective first and second edges, each of said openings being substantially rectangular and has a larger dimension extending parallel to, and a smaller dimension extending transversely of, the direction of flow of the transport medium; and wherein the ratio of the distance of that of said first and second edges that is closer to said opening of said one chute to said larger dimension of said opening is between 0 and 0.3.

2. The transport duct as defined in claim 1, and further comprising an additional duct section situated immediately downstream of said one chute as considered in the direction of flow of the transport medium, at which the duct undergoes another abrupt change of direction of between 70° and 110°.

3. The transport duct as defined in claim 1, wherein said abrupt change of direction amounts to 90°.

4. The transport duct as defined in claim 1, wherein the interior of the duct has a predetermined width and a predetermined height; and wherein the ratio of said width to said height lies between 0.3 and 0.6.

5. The transport duct as defined in claim 4, wherein said width is about 17 centimeters and said height is about 40 centimeters.

6. The transport duct as defined in claim 1, and further comprising at least one other duct section at which the duct undergoes another change of direction of between 70° and 110°; and wherein, as considered in the direction of flow of the transport medium, those duct portions that constitute the first of said sections meet at a sharp edge, and at least those duct portions that constitute the last of said sections meet at a sharp curve.

7. The transport duct as defined in claim 1 for use at a location where obstructions are present between the chutes, wherein the duct, due to the presence of at least said one duct section, circumvents at least one such obstruction.

8. The transport duct as defined in claim 1 for use with carding machines arranged in succession, wherein the duct, due to the presence of at least said one duct section, extends past at least one of the carding machines at one side thereof and past at least one other of the carding machines at the other side thereof.

9. The transport duct as defined in claim 1 for use with carding machines arranged in a plurality of parallel straight rows and columns, wherein the duct includes a plurality of duct portions extending over the individual rows of the carding machines, and a plurality of connection portions extending transversely of said duct portions and each said connection portion joined at each of its ends to a different one of said duct portions by said duct section with said abrupt direction change amounting to substantially 90°.

10. A transport duct of substantially constant rectangular cross section for feeding a fibrous material carried by a transport medium flowing through the interior of the duct via respective openings into a plurality of chutes which are spaced from one another longitudinally of the duct and lead to processing equipment for the fibrous material, comprising at least one duct section situated immediately upstream of one of said chutes as considered in the direction of flow of the transport medium, at which the duct undergoes an abrupt change of direction of between 70° and 110° for the fibrous material to be decelerated by contact with the duct and descend more abundantly than otherwise onto said one chute, said duct including a top wall, a bottom wall, and two lateral walls together bounding the interior of the duct; and a control plate mounted in said interior for pivoting about an axis located at said bottom wall and extending transversely of the direction of flow between an open position in which said control plate rests on said bottom wall and a plurality of closing positions in which it partially obstructs the flow of said transport medium, said control plate being situated immediately upstream of said section and extending in the downstream direction from said axis, and being arrestable in said positions thereof.

11. The transport duct as defined in claim 10, and further comprising a blocking portion secured to said control plate at an end portion of the latter which is remote from said axis and extending downwardly from such end portion; and wherein said bottom wall has an aperture through which said blocking portion extends in all of said positions of said control plate.

12. The transport duct as defined in claim 10; further comprising an additional duct section situated downstream of said one chute as considered in said flow direction, at which the duct undergoes another abrupt change of direction of between 70° and 110°; and further comprising means for controlling the flow of transport medium opposite to said flow direction, including an additional control plate mounted in said interior for pivoting about another axis located at said bottom wall and extending transversely of said flow direction between its open position in which it rests on said bottom wall and a plurality of closing positions in which it partially obstructs the flow of the transport medium opposite to said flow direction, said, additional control plate being situated immediately downstream of said additional section as considered in said flow direction and extending from said axis in the opposite direction than said first control plate, and being arrestable in said positions thereof.

* * * * *